United States Patent [19]

Tamutus

[11] Patent Number: 4,650,435

[45] Date of Patent: Mar. 17, 1987

[54] METHOD OF MAKING A FOCUSING COLOR-SELECTION STRUCTURE FOR A CRT

[75] Inventor: Donald J. Tamutus, Mercerville, N.J.

[73] Assignee: RCA Corporation, Princeton, N.J.

[21] Appl. No.: 217,797

[22] Filed: Dec. 18, 1980

[51] Int. Cl.[4] ..... H01J 9/00

[52] U.S. Cl. ..... 445/47; 445/37; 430/5; 156/644

[58] Field of Search ..... 29/25.15, 25.16; 430/5; 156/644; 445/37, 47

[56] References Cited

U.S. PATENT DOCUMENTS

| | | | |
|---|---|---|---|
| 4,160,311 | 7/1979 | Ronde et al. | 29/25.15 |
| 4,164,059 | 8/1979 | Van Esdonk | 29/25.15 |
| 4,222,159 | 9/1980 | Koorneef | 29/25.16 |

*Primary Examiner*—Kenneth J. Ramsey

*Attorney, Agent, or Firm*—Eugene M. Whitacre; Dennis H. Irlbeck; Vincent J. Coughlin, Jr.

[57] ABSTRACT

The novel method comprises (a) producing on one surface of a metal plate an array of substantially-parallel ridges, at least the tops of the ridges being electrically insulating, (b) producing an array of generally rectangular-shaped apertures through the plate in columns between the ridges and (c) producing electrically-conducting strips on the tops of the ridges.

9 Claims, 16 Drawing Figures

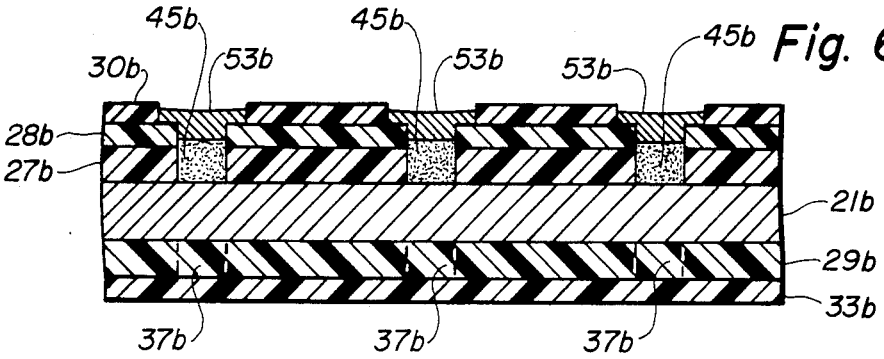
Fig. 6
Fig. 7
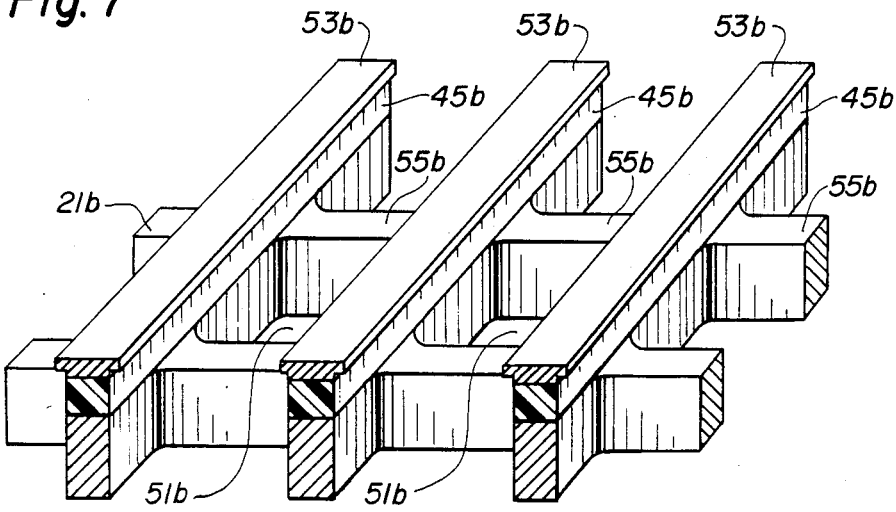

METHOD OF MAKING A FOCUSING COLOR-SELECTION STRUCTURE FOR A CRT

BACKGROUND OF THE INVENTION

This invention relates to a novel method of making a quadrupolar focusing color-selection structure for a CRT (cathode-ray tube).

A commercial shadow-mask-type color television picture tube, which is a CRT, comprises generally an evacuated envelope having therein a target comprising an array of phosphor elements of three different emission colors arranged in color groups in cyclic order, means for producing three convergent electron beams directed towards the target, and a color-selection structure including a masking plate between the target and the beam-producing means. The masking plate shadows the target, and the differences in convergence angles permit the transmitted portions of each beam, or beamlets, to select and excite phosphor elements of the desired emission color. At about the center of the color-selection structure, the masking plate of a commercial CRT intercepts all but about 18% of the beam current; that is, the plate is said to have a transmission of about 18%. Thus, the area of the apertures of the plate is about 18% of the area of the masking plate. Since there are no focusing fields present, a corresponding portion of the target is excited by the beamlets of each electron beam.

Several methods have been suggested for increasing the transmission of the masking plate; that is, increasing the area of the apertures relative to the area of the masking plate, without substantially increasing the excited portions of the target area. In one approach, each of the apertures of the color-selection structure is defined by a quadrupolar electrostatic lens which focuses the beamlets passing through the lens in one direction and defocuses them in another direction on the target depending upon the relative magnitudes and polarities of the electrostatic fields comprising the lens. In one type of quadrupolar-lens color-selection structure described, for example, in U.S. Pat. No. 4,059,781 to W. M. Van Alphen et al, a strong focusing quadrupolar lens is generated from voltages applied between an apertured masking plate and an array of conducting strips which are disposed between columns of the apertures and are insulatingly spaced from one major surface of the plate. In a typical color-selection structure of this type, the apertures may be about 0.65 mm (26 mils) wide on about 0.77 mm (30 mils) centers horizontally and 0.62 mm (24 mils) high on about 0.77 mm (30 mils) centers vertically, and the conducting strips may be about 0.14 mm (6 mils) wide and spaced about 0.05 mm (2 mils) from the plate.

Because of the small and precise sizes required of the apertures and the strips, special techniques must be employed to fabricate structures of this type at reasonable cost. Several methods have been suggested previously. But, each prior method appears to be too costly and may not produce an adequate yield of acceptable structures.

SUMMARY OF THE INVENTION

The novel method comprises (a) providing a metal plate having two opposed major surfaces, (b) producing on one of the major surfaces an array of substantially-parallel ridges separated by valleys therebetween, at least the tops of the ridges being electrically-insulating, (c) producing an array of apertures through the plate into the valleys, with the apertures arranged in columns that are substantially parallel to the lengths of said ridges, and (d) producing electrically-conducting strips on the tops of the ridges and spaced from the plate.

In a preferred embodiment, the ridges may be made by first producing a temporary stencil, as by a photographic technique, on the one major surface, filling the open areas of the stencil with electrically-insulating material, such as an organic insulator or particles of inorganic insulator and a binder. Optionally, grooves may be selectively etched in the one major surface through the stencil prior to filling the open areas of the stencil. Where the stencil is filled with particles of inorganic insulator, the binder may be removed and the particles consolidated, as by heating, before the electrically-conducting strips are applied to the tops of the ridges.

BRIEF DESCRIPTION OF THE DRAWINGS

FIG. 6 is a sectional elevational view of a metal plate during fabrication into a color-selection structure according to a fourth embodiment of the novel method.

FIG. 7 is a perspective view of a fragment of the structure prepared by the fourth embodiment.

DETAILED DESCRIPTION OF THE PREFERRED EMBODIMENTS

Figure 1A:
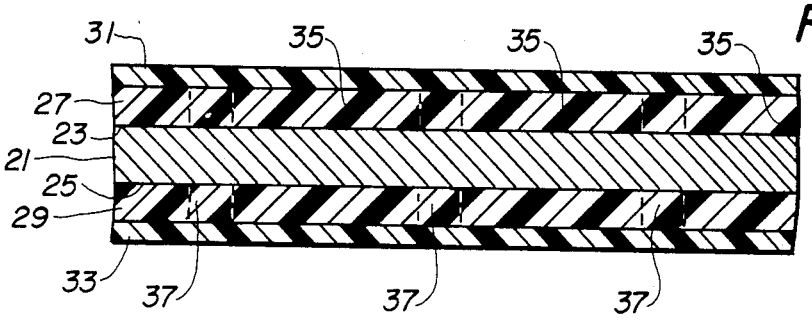
FIGS. 1A through 1F are a series of sectional elevational views of a metal plate during fabrication into a color-selection structure according to a first embodiment of the novel method.

The first embodiment of the novel method is illustrated by the sequence of figures shown in FIGS. 1A through 1F. In FIG. 1A, a thin metal sheet or plate 21 is coated on both opposed major surfaces 23 and 25 with photoresist layers 27 and 29, respectively, that have prescribed thicknesses. The metal plate 21 preferably is about 0.15 mm (6 mils) thick, although other thicknesses may be used. The plate 21 is of a copper alloy containing about 2-weight-percent beryllium and known as Berylco 25. Other metals or metal alloys, such as cold rolled steel, also may be used. Any of several different photoresists may be used. The photoresist layers used in this example are precast sheets marketed under the name Riston 210R by E. I. du Pont, Wilminton, Del. Each photoresist layer is a sheet about 0.025 mm (1 mil) thick that is sandwiched between a sheet of mylar and a sheet of polyethylene. In use, the polyethylene sheet is stripped off, and then the photoresist sheets 27 and 29 are laminated to each major plate surface 23 and 25, respectively, with the mylar sheets 31 and 33 covering the photoresist sheets or layers 27 and 29, respectively.

Selected areas 35 and 37 on the photoresist layers 27 and 29, respectively, are exposed to an image of actinic radiation, as by contact exposure through templates or photographic working plates, whereby there are produced in each layer regions which are more soluble and regions which are less soluble in a particular developer. The photoresist layers 27 and 29 in this example, being negative acting, are insolubilized in the regions 35 and 37 by the exposing actinic radiation. The mylar sheets 31 and 33 remain in place prior to and during the exposure step of the photoresist layers 27 and 29.

Figure 1B:
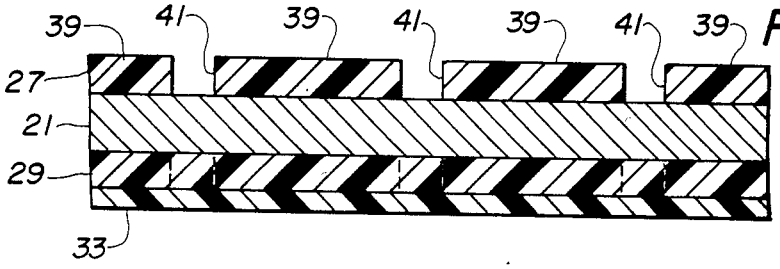

Next, as illustrated in FIG. 1B, the mylar sheet 31 on the upper side of the plate 21 is removed, and the exposed photoresist layer 27 on the upper side of the plate 21 is developed, leaving a first stencil 39 having ridge-defining open areas 41 therein. The preferred developer is an aqueous liquid marketed under the name Riston II Developer 2000 by E. I. du Pont, Wilmington, Del. The mylar sheet 33 on the lower side of the plate is left in place, and the other exposed photoresist layer 29 remains undeveloped. The ridge-defining open areas are about 0.15 mm (6 mils) wide on about 0.76 mm (30 mils) centers and extend about the length of the plate 21.

Figure 1C:
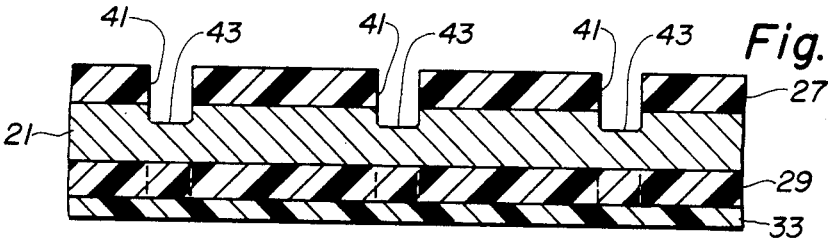

Next, as shown in FIG. 1C, the metal plate 21 is etched partially through by applying a suitable etchant through the ridge-defining open areas 41 to produce an array of substantially-parallel relatively narrow grooves 43 about 0.10 mm (4 mils) deep. The preferred etchant is an aqueous ferric chloride solution marketed under the name R.C.E. Solution by Philip A. Hunt Chemical Corp., Palisades, N.J. After the grooves 43 are etched, the external surfaces of the plate are rinsed with deionized water to remove any residual etchant thereon.

Figure 1D:
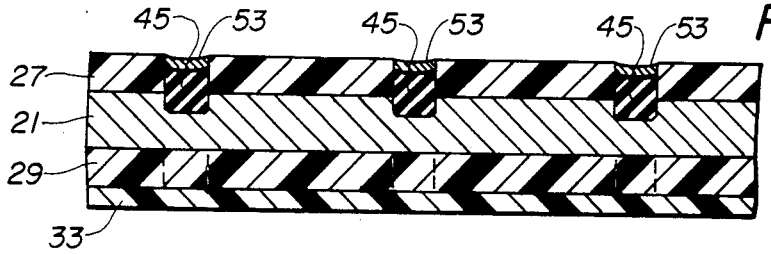

Next, as shown in FIG. 1D, the grooves 43 and open areas 41 on the upper side of the plate 21 are filled with electrically-insulating material. Inorganic material or organic polymeric material which can tolerate subsequent processing can be used. In this example, the grooves 43 and open areas 41 are filled, as by doctor-blading, with a polyimide, such as Pyralin PI 2550 marketed by E. I. du Pont, Wilmington, Del., which is an organic polymeric material, and then dried. The dried electrically-insulating material 45 filling the grooves 43 and the open areas 41 is thereby cast in place and subsequently becomes an array of narrow ridges separated by relatively wide valleys described below. There is considerable shrinkage after the polyimide has dried, as shown in FIG. 1D, leaving a substantial depression above the dried electrically-insulating material 45. At this point, an electrically-conductive paste is doctor-bladed into the depressions on top of the electrically-insulating material 45 and dried, producing electrically-conducting strips 53. One suitable electrically-conducting paste consists essentially of particulate silver metal dispersed in the above-mentioned polyimide polymer.

Figure 1E:
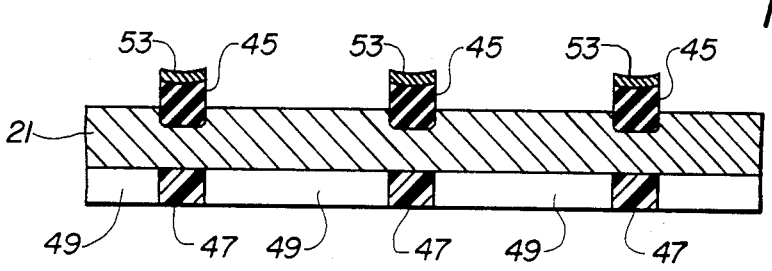

After the grooves 43 are filled, the first stencil 39 is removed as shown in FIG. 1E. In this example, acetone is applied to the first stencil until it softens, and then it is lifted off the plate 21 leaving upstanding ridges 45. Also, the lower mylar sheet 33 is removed, and the lower photoresist layer 29 is developed as described above for the upper photoresist layer 27, leaving a second stencil 47 having therein open aperture-defining areas 49. The aperture-defining areas 49 are about 0.60 mm (24 mils) wide on about 0.77 mm (30 mils) centers, as shown in FIG. 1E, are about 0.30 mm (12 mils) high on about 0.46 mm (18 mils) centers, and are opposite the space or valley between the ridges 45.

Figure 1F:
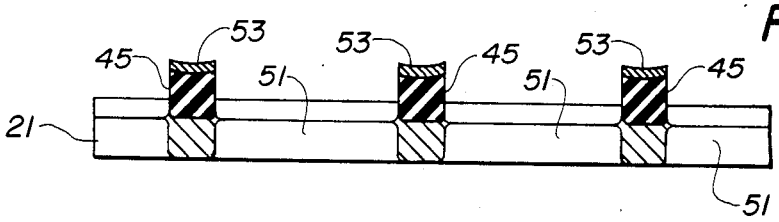

Next, as shown in FIG. 1F, the metal plate 21 is etched through from both sides with liquid etchant applied through the open aperture-defining areas 49 and the spaces between the ridges, producing apertures 51. Then, the external surfaces of the plate 21 are rinsed with deionized water to remove any residual etchant. The etching and rinsing steps may be carried out as described above with respect to FIG. 1C. Next, the second stencil 47 is removed. Since electrically-conducting material is already deposited on the tops of the ridges 45, the mask is completely fabricated at this point as shown in FIG. 1F.

Figure 2:
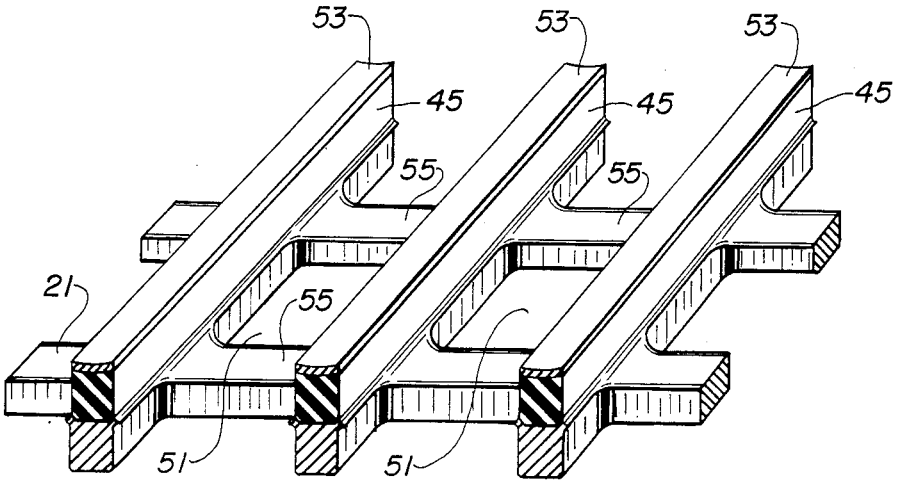
FIG. 2 is a perspective view of a fragment of a color-selection structure prepared by the first embodiment of the novel method.

A fragment of the finished color-selection structure with polyimide ridges 45 is shown in the perspective view of FIG. 2. The apertures 51 in the plate 21 are defined in part by crossbars 55 which contribute to the mechanical strength of the structure.

Figure 3A:
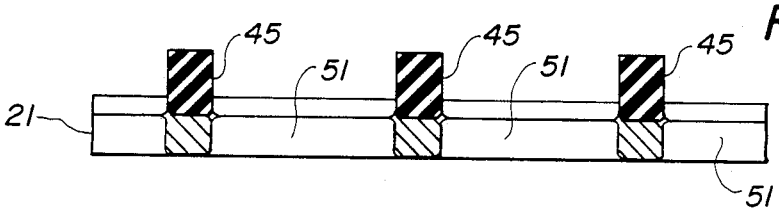
FIGS. 3A and 3B are sectional elevational views of a metal plate illustrating two steps in a second embodiment of the novel method.
Figure 3B:
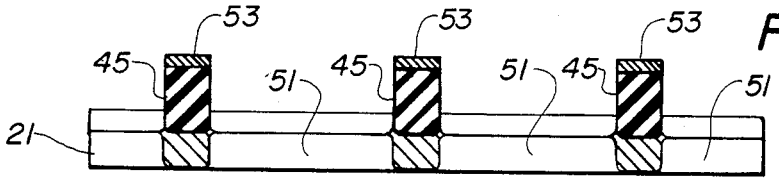

In a second embodiment of the novel method, a physical mixture of glass particles, sometimes referred to as frit, and a volatilizable binder therefor is doctor-bladed into the grooves 43 and open areas 41 of the structure shown in FIG. 1C. Apertures are etched as in the first embodiment, and then the structure is heated in air to volatilize the binder and to consolidate the glass particles, producing the structure shown in FIG. 3A. Then, as shown in FIG. 3B, the tops of the ridges 45 are metalized; that is, metal strips 53 are deposited on the ridges 45 and spaced from the metal plate 21. Metalization may be accomplished by vapor-deposition of a metal, such as aluminum, at low ambient pressures. Or, a conductive paste may be doctor-bladed over the ridges and then cured. Or, conductive strips can be cast over the ridges. Or, prefabricated conductive metal strips may be transferred from a temporary substrate to the tops of the ridges 45.

The third embodiment of the novel method is similar to the above-described first embodiment, except that the step of etching grooves 43 shown in FIG. 1C is omitted. The first stencil is not removed from the one surface 23 of the plate 21 prior to etching the apertures, which is conducted entirely from the other surface 25 of the plate 21. The height of the ridges 45 is determined by the thickness of the first stencil 27 which can be modified by altering the thickness of the first stencil; for example, by using one or more layers of photoresist.

Figure 4A:
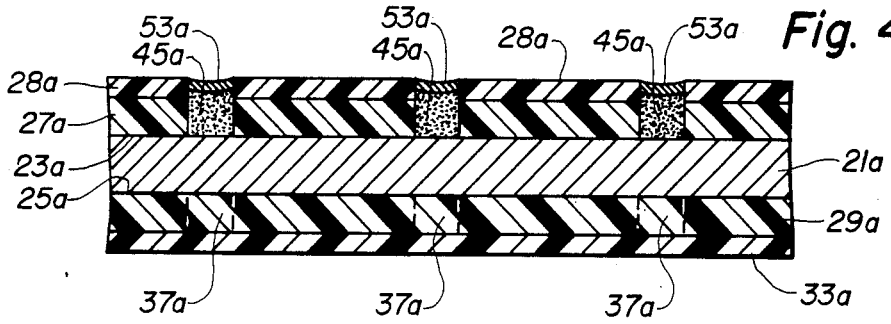
FIGS. 4A through 4D are a series of sectional elevational views of a metal plate during fabrication into a color-selection structure according to a third embodiment of the novel method.

The third embodiment is illustrated in FIGS. 4A through 4D in which a first stencil is produced on one major surface (the upper surface **23*a* in FIG. 4A) of a metal plate 21*a*, and an exposed photoresist layer 29*a* is produced on the other major surface (the lower surface 25*a* in FIG. 4A). The first stencil is comprised of two layers 27*a* and 28*a* in order to provide a thicker overall first stencil than that shown in FIG. 1B. The open areas of the first stencilare filled with an electrically-insulating material 45*a* as described above for the first embodiment. When a polyimide is used to fill the first stencil, the tops of the ridges 45*a* are metalized at this point with an electrically-conducting paste by doctor-blading as described above with respect to FIG. 1D. FIG. 4A shows the tops of the ridges 45*a* coated with electrically-conducting strips 53*a*. Alternatively, as in the second embodiment, the open areas of the first stencil may be filled with a frit-and-binder paste, in which case, metalization of the tops of the ridges 45*a* is postponed to the end of the process in a manner similar to that described with respect to FIG. 3A and 3B**.

Figure 4B:
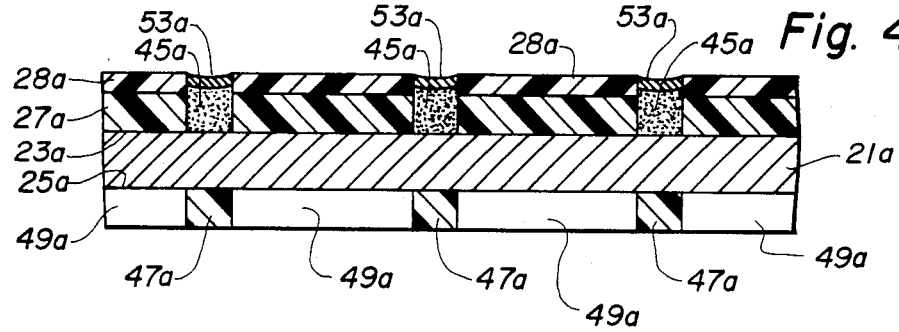
Figure 4C:
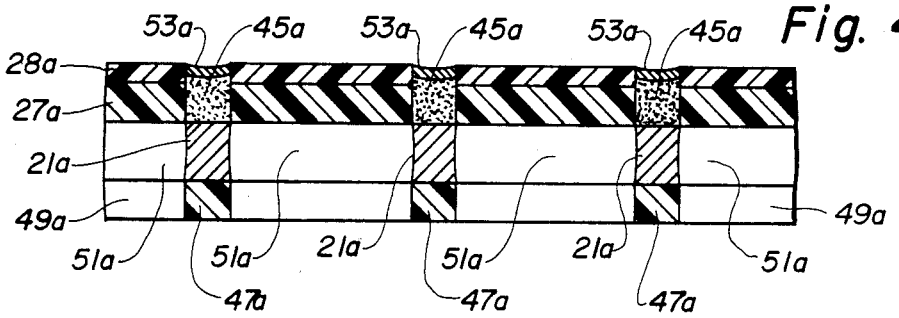
Figure 4D:
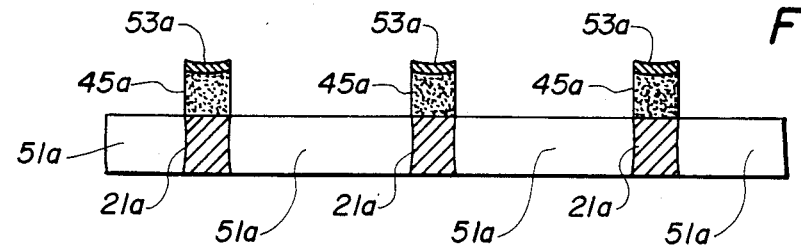
Figure 5:
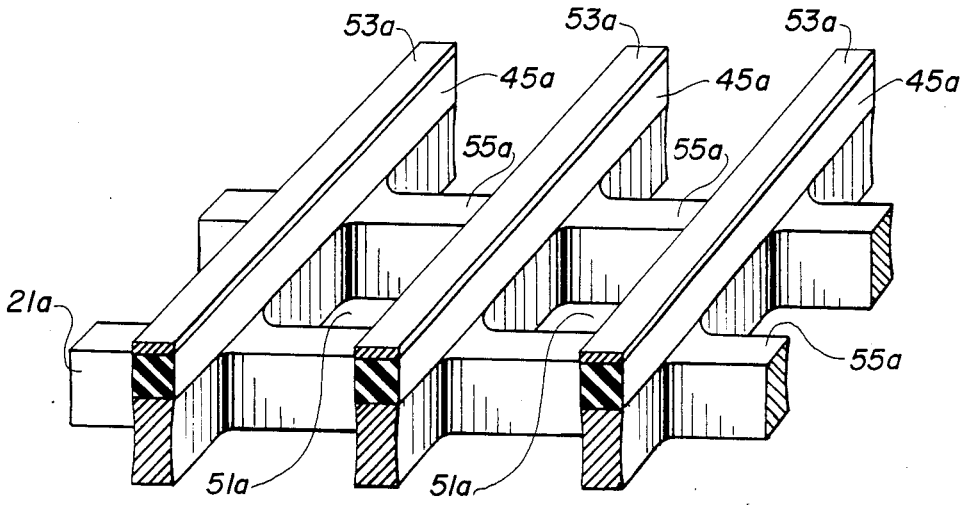
FIG. 5 is a perspective view of a fragment of a color-selection structure prepared by the third embodiment of the novel method.

Then, as shown in FIG. 4B, the protective mylar layer **33*a* is removed, and the exposed photoresist 29*a* is developed, producing a second stencil 47*a* having therein open aperture-defining areas 49*a*. As shown in FIG. 4C**, with the first stencil still in place, apertures 51*a* are etched through the plate 21*a* by applying an etchant to the one side 25*a* of the plate 21*a* using only the second stencil 47*a*. Then, as shown in FIG. 4D, the first and second stencils 27*a* and 29*a* are removed; for example, by softening the stencils with acetone and then lifting them off. When frit-and-binder is used to prepare the ridges 45*a*, electrically-conducting strips 53*a* are now produced on the tops of the ridges 45*a*. A fragment of the finished product is shown in the perspective view of FIG. 5.

It is sometimes desirable to have the conducting metal strips overhang the ridges 45; that is, they are wider than the ridges 45 and extend beyond the sides of the ridges on both sides thereof. This may be accomplished by a fourth embodiment of the novel method with reference to FIG. 6. A metal plate 21*b* is coated on both major surfaces 23*b* and 25*b* thereof with photoresist layers 27*b*, 28*b* and 29*b* as in the third embodiment. The layers 27*b*, 28*b* and 29*b* are exposed to images of actinic radiation, and the upper layers 27*b* and 28*b* are developed, yielding essentially the same intermediate structure that is shown in FIG. 4A. At this point, grooves may be etched in the plate substantially as shown in FIG. 1C, or that step may be omitted. In this fourth embodiment, the step of etching grooves is omitted, and the open ridge-defining areas of the upper first stencil are filled with electrically-insulating material substantially as described above, producing ridges 45*b*.

In this fourth embodiment, a polyimide is doctor-bladed into the open areas and permitted to dry. Next, a fourth photoresist layer 30*b*, preferably a Riston sheet, is laminated on top of the first stencil. A photographic working plate (not shown) with an identical, but slightly wider, pattern of light-absorbing strips as the open areas of the first stencil is registered to the ridges 45*b*, and the fourth layer 30*b* is exposed through the working plate to actinic radiation. The mylar protective layer (not shown) is removed, and the fourth layer is developed producing a third stencil 30*b* having open, conductive-strip-defining openings therein. An electrically-conducting paste is doctor-bladed into the open areas of the third stencil 30*b* on top of the ridges 45*b* and then dried, producing conducting strips 53*b*, as shown in FIG. 6. Then, the second mylar layer 33*b* is removed, the second stencil developed, and the plate 21*b* is etched substantially as described for the third embodiment. Then, the first, second and third stencils are removed. A fragment of the finished color-selection structure is shown in FIG. 7.

I claim:

1. A method for making a color-selection structure for a cathode-ray tube comprising A. providing a metal plate having two opposed major surfaces, B. casting on one of said major surfaces an array of substantially-parallel ridges separated by valleys therebetween, at least the tops of said ridges being electrically insulating, C. producing an array of apertures through said plate, said apertures being arranged in columns that are substantially parallel to the lengths of said ridges and extend into said valleys, D. and then producing electrically-conducting strips on said electrically-insulating tops of said ridges.

2. The method according to claim 1 wherein step B. comprises (i) producing a first stencil on said one major surface, said stencil having a prescribed thickness and including therein substantially-parallel, striplike, ridge-defining open areas, (ii) filling said open areas of said first stencil with electrically-insulating material (iii) and then removing said first stencil.

3. The method according to claim 1 wherein step B. comprises (i) producing a first etch-resistant stencil on said one major surface, said stencil having a prescribed thickness and including therein substantially-parallel, striplike, ridge-defining open areas, (ii) etching said one major surface through said open areas of said first stencil to a desired depth less than the thickness of said plate, (iii) filling said open areas of said first stencil with electrically-insulating material (iv) and then removing said first stencil.

4. The method according to claim 1 wherein step C. comprises (i) producing a second etch-resistant stencil on the other major surface of said plate, said second stencil having therein open aperture-defining areas with prescribed patterns, said open aperture-defining areas being opposite said valleys, (ii) etching apertures through said plate by applying etchant at least through said aperture-defining open areas of said second stencil (iii) and removing said second stencil.

5. A method for making a color-selection structure for a cathode-ray tube comprising A. providing a metal plate having two opposed major surfaces, B. producing a first etch-resistant stencil on one major surface of said plate, said first stencil having a prescribed thickness and having therein substantially-parallel relatively-narrow striplike open ridge-defining areas, C. filling said open ridge-defining areas of said stencil with electrically-insulating material, D. producing a second etch-resistant stencil on said other major surface of said plate, said second stencil having therein open aperture-defining areas arranged in columns that are substantially parallel to said ridge-defining areas, E. etching apertures through said plate by applying an etchant at least through said open aperture-defining areas of said second stencil, F. removing said first and second stencils, while retaining ridges of said electrically-insulating material in place G. and covering selected surface portions of said ridges of electrically-insulating material with electrically-conducting material, said electrically-conducting material being spaced from said plate.

6. The method defined in claim 5 wherein step C. comprises:

(i) covering the other major surface with an etch-resistant layer, (ii) etching depressions into said plate by applying an etchant through said open ridge-defining areas of said first stencil, (iii) filling said depressions and said open ridge-defining areas of said first stencil with electrically-insulating material.

7. The method defined in claim 5 wherein step G. comprises:

(i) producing a third stencil on said first stencil, said third stencil having therein open strip-defining areas, (ii) filling said open areas of said third stencil with electrically-conducting material, (iii) and removing said third stencil.

8. The method according to claim 1 wherein step B. comprises (i) selectively etching grooves on said one major surface, to define substantially-parallel, striplike, ridge-defining open areas, (ii) filling said open areas with electrically-insulating material, and (iii) etching said one major surface between the electrically-insulating material to form said valleys.

9. The method according to claim 8 wherein the metal sheet wich forms sides of said grooves is only partially etched so that the lower side portions of said grooves remain in the completed color-selection structure.

* * * * *